US007855344B2

(12) United States Patent
Arcand

(10) Patent No.: US 7,855,344 B2
(45) Date of Patent: Dec. 21, 2010

(54) REVERSING SWITCH

(75) Inventor: Sebastien Arcand, St. Augustin-de-desmaures (CA)

(73) Assignee: Andritz Technology and Asset Management GmbH, Graz (AT)

( * ) Notice: Subject to any disclaimer, the term of this patent is extended or adjusted under 35 U.S.C. 154(b) by 809 days.

(21) Appl. No.: 11/833,303

(22) Filed: Aug. 3, 2007

(65) Prior Publication Data

US 2008/0185270 A1 Aug. 7, 2008

(30) Foreign Application Priority Data

Feb. 2, 2007 (CA) ..... 2576846

(51) Int. Cl.
*H01H 9/00* (2006.01)

(52) U.S. Cl. ..... 200/1 V; 318/280

(58) Field of Classification Search ..... 200/1 R, 200/1 V, 6 R, 17 R, 18, 11 TC, 48 R–48 KB, 200/50.32, 50.33, 50.35, 337; 335/159, 160, 335/162, 202; 218/7, 153, 154; 318/280; 307/127

See application file for complete search history.

(56) References Cited

U.S. PATENT DOCUMENTS 2,780,762 A * 2/1957 Gayer ..... 318/753
2,807,684 A * 9/1957 Ayers ..... 200/1 V
3,426,167 A * 2/1969 Schlienger ..... 200/82 R
3,673,426 A * 6/1972 Weston et al. ..... 307/127
3,800,103 A * 3/1974 Hardi-Kern et al. ..... 200/1 V
3,851,130 A * 11/1974 Paulson ..... 200/502
4,357,502 A 11/1982 Beck
4,396,811 A * 8/1983 Kljucaricek ..... 200/1 V
4,513,181 A * 4/1985 Boysen et al. ..... 200/50.33
4,618,807 A * 10/1986 Wiessner et al. ..... 318/280
4,639,558 A * 1/1987 Lycan ..... 200/1 V
5,216,212 A * 6/1993 Golowash et al. ..... 200/1 V
5,936,213 A 8/1999 Biquez et al.
6,140,896 A * 10/2000 Heckenkamp ..... 335/159

* cited by examiner

*Primary Examiner*—Michael A Friedhofer
(74) *Attorney, Agent, or Firm*—Nixon & Vanderhye P.C.

(57) ABSTRACT

A reversing switch for use in a multi-phase electrical system, and in particular a three phase electrical system has a conductor for linking the input and output of one of the three phases. The reversing switch has two phase switches for reversing polarity. Each phase switch has a pair of stationary contacts and a moveable contact for reversing phase by switching between the stationary contacts. The moveable contacts of each phase switch are moveable in unison by a motor and associated transmission during switching of the reversing switch between first and second modes of operation of opposite polarity.

8 Claims, 5 Drawing Sheets

REVERSING SWITCH

FIELD OF THE INVENTION

The present invention relates to a reversing switch for use in a multi-phase electrical system and in particular relates to apparatus for effecting phase reversal operation in a multi-phase electrical system.

BACKGROUND OF THE INVENTION

Certain applications in the generation, transmission, distribution, and utilization of electrical energy require the reversal of phases of a polyphase electrical system. For example, pumped-storage electrical generation projects utilize a dual mode electric machine as a pump motor to pump water into a reservoir to increase the head behind a dam. This pumping occurs during off-peak hours. During peak demand for electricity on a power grid, the reservoir is drained to drive the electric machine as a generator to produce electric power for the grid. The electric machine is switched between pump motor and generator operation by reversing the phase connections to the machine.

To provide phase reversal in a three-phase electrical system, it is known to use a five-pole non-segregated reversing switch and a mechanism for operating the poles in the proper sequence to prevent short circuiting. In operation, three poles are closed at the same time that two other poles are opened in a disconnect position. To reverse polarity, the two other poles are closed when two of the other three poles are opened. In this manner two of the three phases are reversed. This type of switch is relatively expensive to manufacture due to the use of five poles. Further the five poles usually require a significant amount of room within a switch gear enclosure.

BRIEF DESCRIPTION OF THE INVENTION

The present invention relates to a reversing switch for use in a multi-phase electrical system that utilizes two phase switches having two poles in each phase switch to reverse polarity. This reversing switch requires less space than the previous five pole/switch reversing switch and is less expensive to manufacture due to the elimination of switches and associated poles.

In one embodiment, the reversing switch is connected between three input phases and three output phases of an electrical system. The reversing switch has first and second modes of operation of reverse polarity. In this embodiment, the reversing switch comprises a first conductor linking a first one of the three input phases to a first one of the three output phases, a first phase switch, a second phase switch and motor and associated transmission. The first phase switch comprises a first stationary contact adapted for connection with a second one of the three output phases and a second stationary contact adapted for connection with a third one of the three output phases. The first phase switch comprises a first movable contact adapted for connection with a second one of the three input phases. The first moveable contact is movable between a first position contacting the first contact when the reversing switch is operating in the first mode of operation and a second position contacting the second stationary contact when the reversing switch is operating in the second mode of operation. The second phase switch comprises a third stationary contact adapted for connection with the third one of the three output phases and a fourth stationary contact adapted for connection with the second one of the three output phases. The second phase switch comprises a second movable contact adapted for connection with a third one of the three input phases and being movable between a third position contacting the third contact when the reversing switch is operating in the first mode of operation and a fourth position contacting the fourth stationary contact when the reversing switch is operating in a second mode of operation. The motor and associated transmission are adapted for connection with the first and second moveable contacts to move the first and second moveable contacts in unison during switching of the reversing switch between the first and second modes of operation.

In another embodiment, the reversing switch has the first and second phase switches oppositely connected to the electrical system whereby the stationary contacts of the phase switches are connected in a like manner to that described above but to the input phases of the electrical system and the movable contacts of the phase switches are connected to the output phases of the electrical system.

In another embodiment, the first and second phase switches each has a disconnect open position, between which the corresponding first and second moveable contacts are located, and the first conductor further comprises a switch for opening the circuit whereby the reversing switch further functions as a disconnect switch when operating in a third mode of operation.

In another embodiment the moveable contacts comprise blade-like members making wiping electrical contact with stationary contacts of finger-like construction.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

The present invention relates to a reversing switch for use in a multi-phase electrical system and in particular relates to apparatus for effecting phase reversal operation in a multi-phase electrical system.

Figure 1:
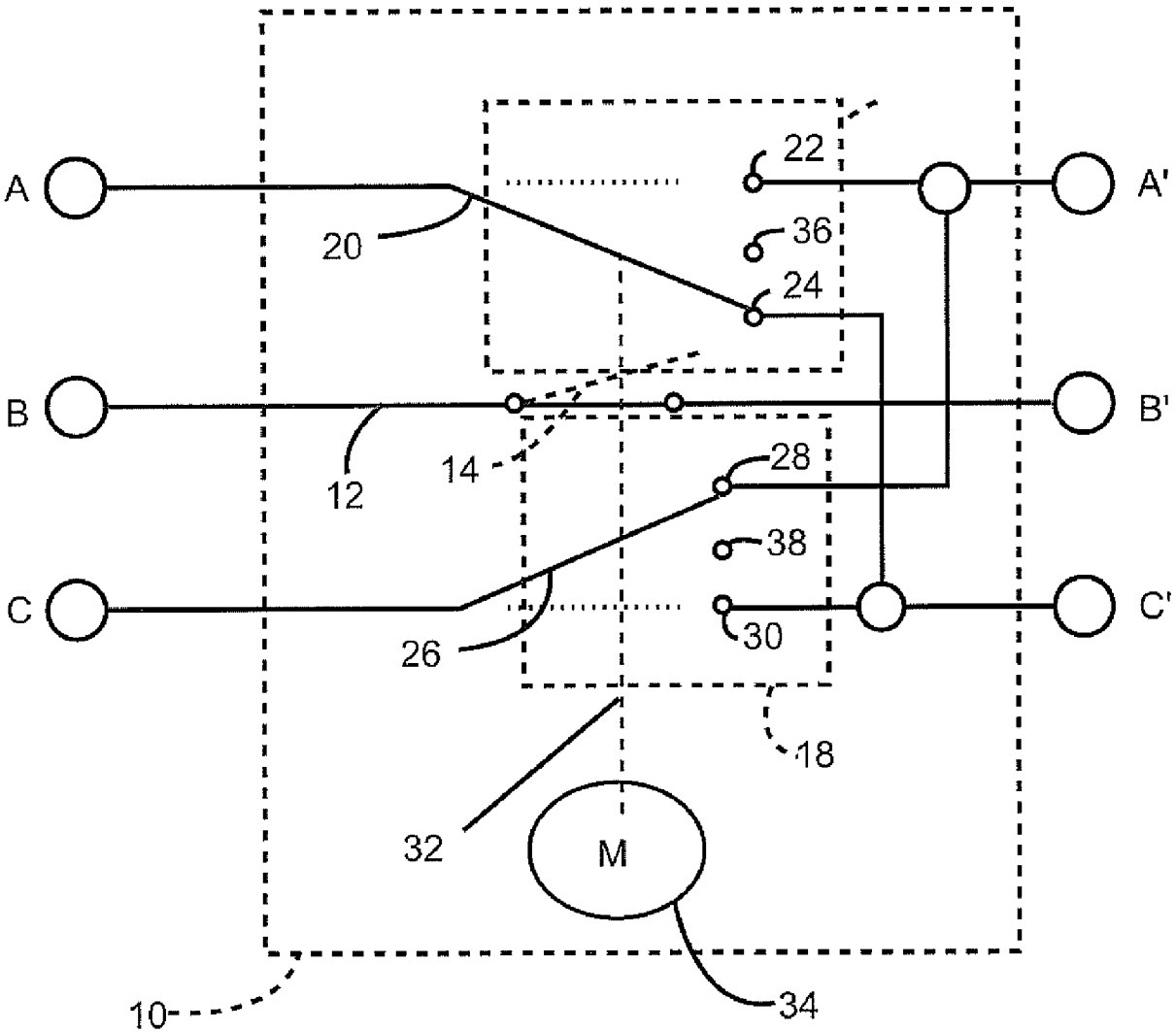
FIG. 1 is a schematic drawing of a first embodiment of the switch of the present invention.

FIG. 1 is a schematic representation of the reversing switch 10 of the present invention. The reversing switch 10 is connected between three input phases A, B, and C and three output phases, A', B', and C'. The switch is shown to comprise a first conductor 12 which links phases B and B' of the input and output phases. In the preferred embodiment this conductor 12 is a solid conductor however in an alternative embodiment to be discussed hereinafter, a moveable contact 14 may be employed.

The reversing switch 10 further comprises first and second phase switches 16 and 18. The first phase switch 16 has a first moveable contact 20 which is connected to phase A of the input phases. Switch 16 has a first stationary contact 22 which is connected to phase A' of the output phases. Switch 16 further has a second contact 24 which is connected to phase C' of the output phases. Likewise switch 18 has a moveable contact 26 which is connected to phase input C of the input phases. Switch 18 further has a first stationary contact 28 which is connected to phase A' and a second stationary contact 30 which is connected to phase C' of the output phases.

The moveable contacts 20 and 26 are controlled by a transmission 32 which is linked to the moveable contacts 20 and 22 and operates under control of motor actuator 34. The reversing switch 10 is shown to have its phase switches 16 and 18 operating in a reverse polarity mode of operation. It should be understood that motor transmission 32 can be moved to cause the contact arms 20 and 26 to move respectively into contact with stationary contacts 22 and 30 so as to provide for another mode of switch operation wherein the polarity of the phases is not reversed.

In an alternative embodiment, the reversing switch 10 may further include a moveable contact 14 forming part of conductor 22 and also include stationary contacts 36 and 38 located respectively within phase switches 16 and 18. When moveable contact 14 is moved into an open position and contacts 20 and 26 are moved into open positions contacting respective contacts 36 and 38, the reversing switch will then be in a condition where no current will pass between the input phases and the output phases. In this mode the switch 10 is effectively acting as a disconnect switch.

Figure 2:
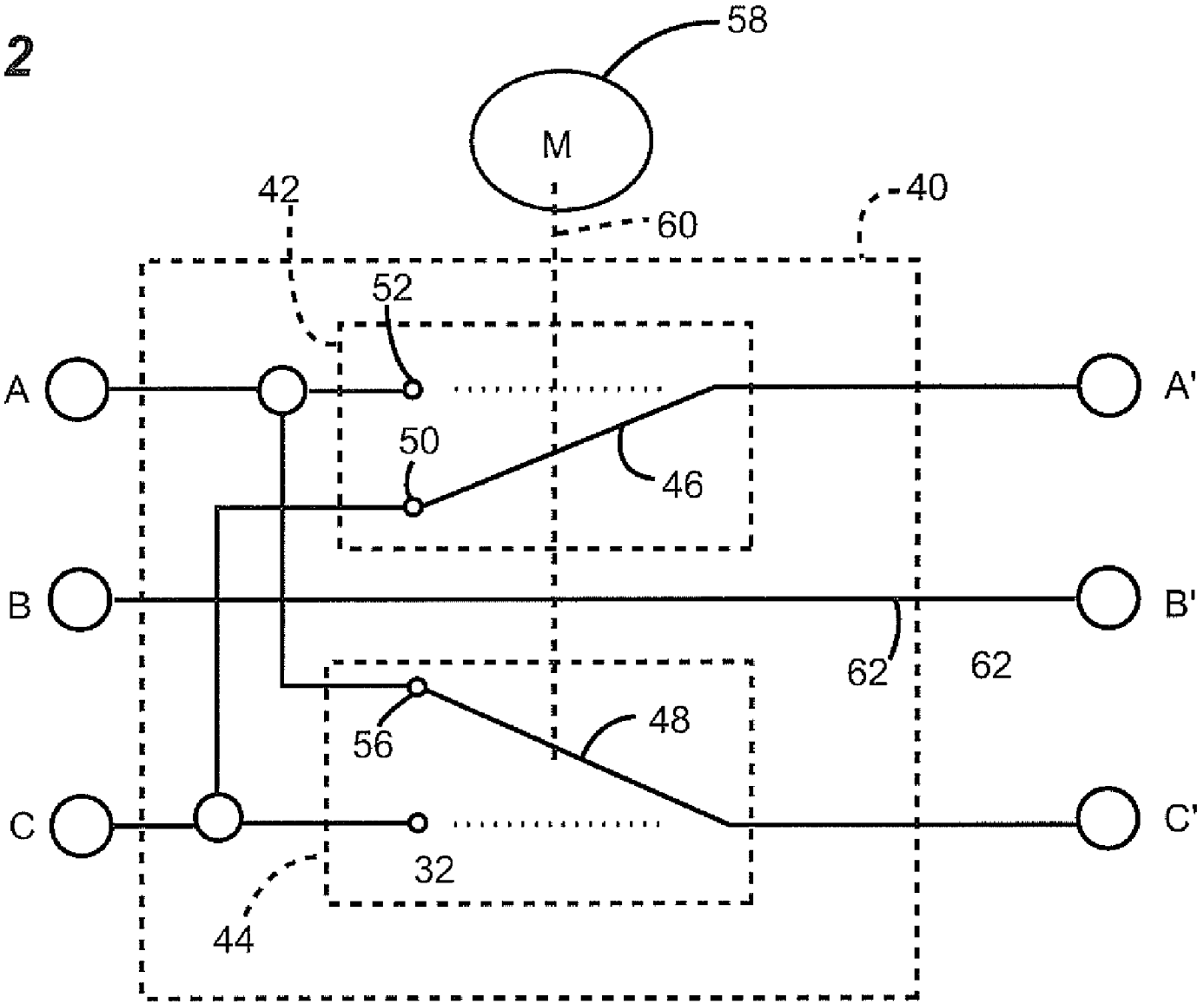
FIG. 2 is a schematic drawing for a second embodiment of the switch of the present invention.

Referring to FIG. 2 there is shown an alternative embodiment to the reversing switch shown in FIG. 1. In FIG. 2 the reversing switch 40 has phase switches 42 and 44 wherein the moveable contacts 46 and 48, respectively of the switches 42, 44, are connected to the output phases A' or C'. The input phases A, B and C are connected to the phase switches 42 and 44 as follows. The phase switch 42 has a stationary contact 50 which is connected to the input phase C. The phase switch 42 has a second stationary contact 52 connected to the input phase A. The phase switch 44 has a stationary contact 54 connected to phase C of the input phases and has a stationary contact 56 connected to the input phase A. The output phase B' is connected to the input phase B via a conductor 62. The moveable contacts 46 and 48 are controlled by a motor 58 and its transmission 60. The transmission 60 operates the moveable contacts 46 and 48 to move in opposing directions in unison between their respective contacts 50, 52 and 56, 54. This results in the reversing of polarity from the input phases A, B and C to the output phases A', B' and C'.

Referring to FIGS. 3 and 4*a* through 4*d* there is shown a reversing switch apparatus 100 for the present invention. The apparatus 100 is provided with a plurality of insulators 102 which are adapted to mount various components of the reversing switch 100 in electrical insulation within an enclosure (not shown).

The reversing switch 100 is shown to comprise input phases A, B, and C and output phases C', B' and A'. It will be noted that the input phase B is connected to the output phase B' by a single conductor 104.

The reversing switch has a first phase switch generally shown at 106. First phase switch 106 has a moveable contact arm 108 which is in the form of a blade. The moveable contact arm 108 has one end pivotally connected at 110 to the input phase A. The other end 112 of the moveable contact arm 108 is of blade-like configuration and is shown in a first position in wiping electrical contact between finger contacts 114. These finger contacts 114 may comprise copper fingers having silver plated contact portions. The finger contacts 114 are connected through conductor 116 to output phase A'. The moveable contact 108 can be pivoted out of contact with contacts 114 and into wiping contact with finger contacts 120 similar in construction to those of contacts 114. Finger contacts 120 are connected through conductor 122 to the C' output phase connection.

The reversing switch 100 further includes a second phase switch 130 which has a moveable contact 132 pivotally connected at 134 to a conductor 136 of the input phase C. The moveable contact 132 is shown to have a contact end portion 138 which is a blade-like configuration and is shown in wiping contact with finger-like contacts 142. Finger-like contacts 142 are shown to be connected through a conductor 144 to the output phase C'. The moveable contact arm 132 pivots out of contact with contacts 142 and into contact with finger-like contacts 150. Finger-like contacts 150 are connected to a conductor bar 152 which forms part of the connection with the A' output phase.

The reversing switch 100 further comprises a motor 160 and transmission 162. Transmission 162 comprises a shaft 163 connected to motor 160. The shaft 163 has a first lever arm 164 that radially extends from the shaft 163 and a second lever arm 166 which also radially extends from the shaft but is angularly offset relative to the first lever 164. The first lever 164 is connected pivotally to an end portion of a link arm 170 which is connected pivotally at its other end portion to a mid portion of the moveable contact 108. This mid-point pivot connection is intermediate of the blade end 112 and the pivoting point 110. The lever 166 is connected to an end portion of a link arm 172 which has a second end portion pivotally connected to end portion 174 of the moveable contact 132. The pivot connection 134 to the arm 132 is located to provide the non-contact end portion 174 extending past the pivot connection 34 and to which the link arm 172 is pivotally connected.

Figure 3:
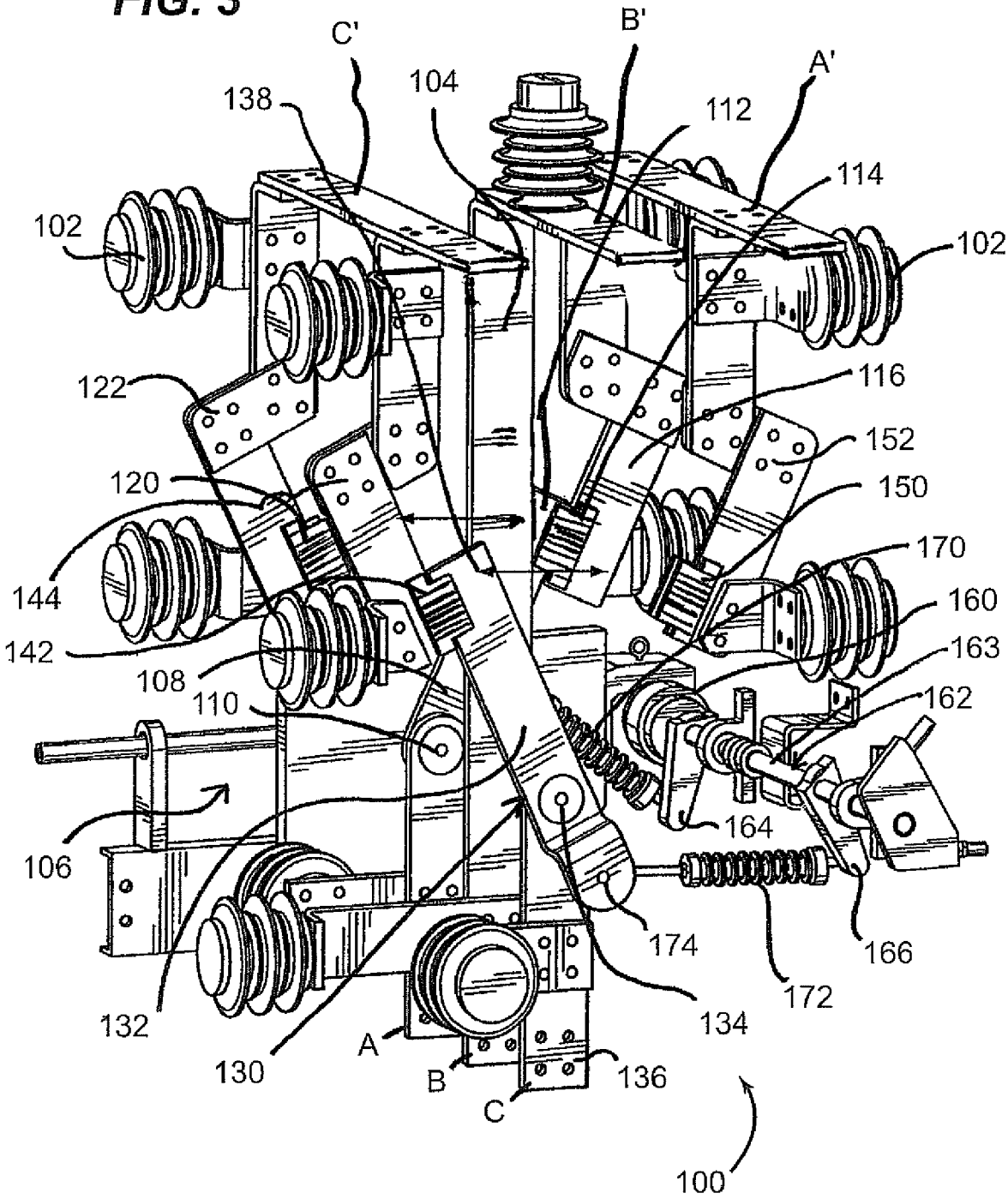
FIG. 3 is a drawing showing a reversing switch in accordance with the present invention; and, FIGS. 4*a*, 4*b*, 4*c* and 4*d*, are side views showing the movement of the reversing blades of the reversing switch of the present invention, wherein the stationary contacts for one of the moveable blade contacts hide rearwardly positioned stationary contacts for the other moveable blade contact.
Figure 4B:
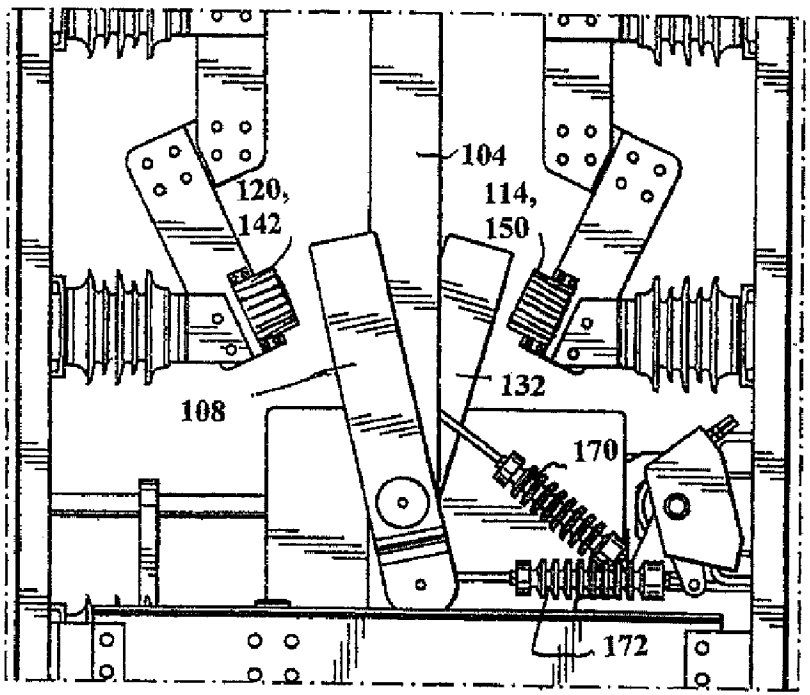
Figure 4A:
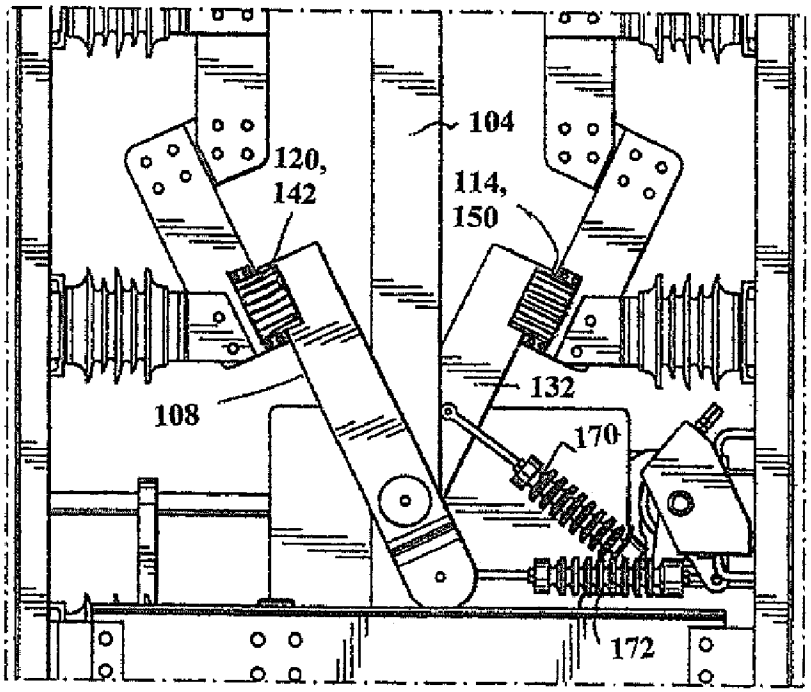
Figure 4D:
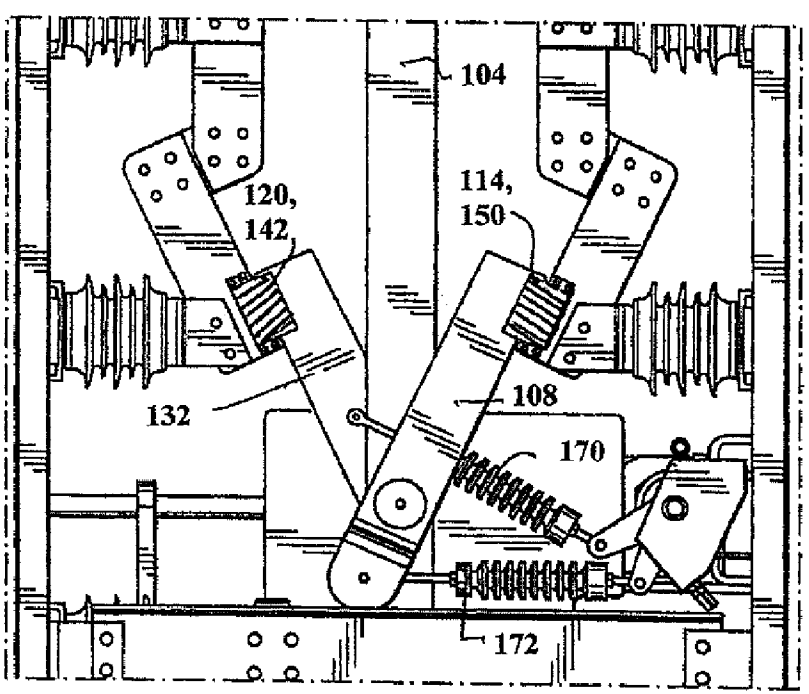
Figure 4C:
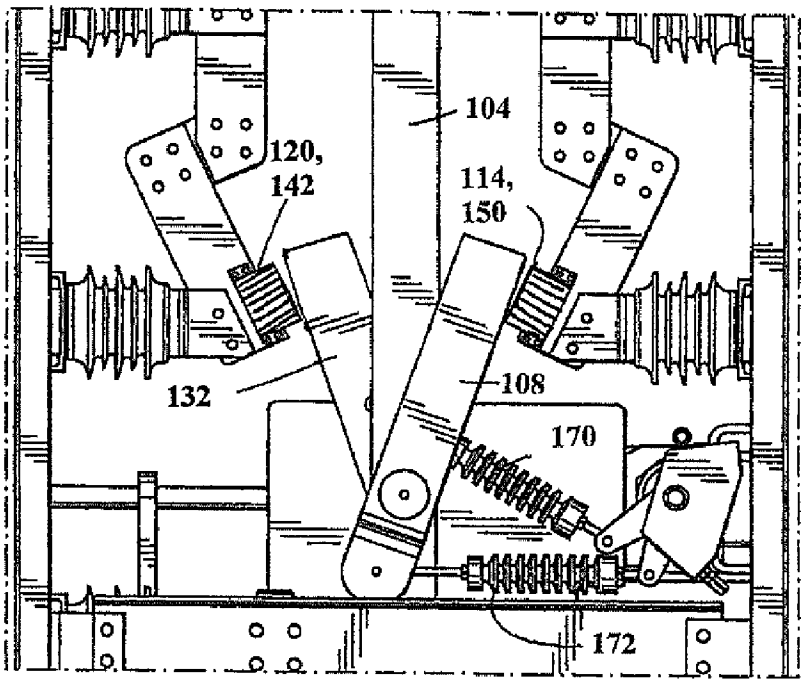

Referring to FIGS. 3 and 4*a* through 4*d*, the movement of the blade moveable contact arms 108 and 132 is shown. As shown in FIG. 3, the moveable contact blades 108 and 132 are shown in a straight forward phase arrangement wherein the input phases A, B, and C are correspondingly connected to the output phases A', B', and C'. The shaft 163 is rotated in a clockwise direction by motor 160 by a predetermined angular amount which causes the lever 166 and the link arm 172 to push against the non-contacting end portion 174 of the moveable blade 132 causing the moveable blade 132 to rotate about pivot 134 moving out of contact with fingers 142 and into contact with contact fingers 150. Simultaneously or in unison, the lever 164 also rotates causing link arm 170 to push contact arm 108 out of contact with finger contacts 114 and into contact with finger contacts 120. In this position the reversing phase switch has reverse polarity between the input phases and the output phases. The use of the shaft 163 together with the linkage arms and levers affects a uniform opposite motion of the moveable contact blades. The shaft may be rotated back into an opposing direction to a resulting position shown in FIG. 3 to cause the moveable contacts to be pulled in the opposite direction. Accordingly, rotation of the shaft by the motor in opposing directions results in counter pivoting movement of the two moveable contact blades to effect reversing of polarity.

While the invention has been described in terms of various specific embodiments, those skilled in the art will recognize that the invention can be practiced with modifications within the spirit and scope of the claims.

The invention claimed is:

1. A reversing switch connected between three input phases and three output phases of an electrical system and having first and second modes of operation of reverse polarity, the reversing switch comprising:

a first conductor linking a first one of the three input phases to a first one of the three output phases;

a first phase switch comprising a first stationary contact adapted for connection with a second one of the three output phases and a second stationary contact adapted for connection with a third one of the three output phases, and the first phase switch comprising a first movable contact adapted for connection with a second one of the three input phases and being movable between a first position contacting the first contact when the reversing switch is operating in the first mode of operation and a second position contacting the second stationary contact when the reversing switch is operating in the second mode of operation;

a second phase switch comprising a third stationary contact adapted for connection with the third one of the three output phases and a fourth stationary contact adapted for connection with the second one of the three output phases, and the second phase switch comprising a second movable contact adapted for connection with a third one of the three input phases and being movable between a third position contacting the third contact when the reversing switch is operating in the first mode of operation and a fourth position contacting the fourth stationary contact when the reversing switch is operating in a second mode of operation; and, a motor and associated transmission adapted for connection with the first and second moveable contacts to move the first and second moveable contacts in unison during switching of the reversing switch between the first and second modes of operation.

2. The reversing switch of claim 1 wherein the first and second phase switches each has a disconnect open position between the corresponding first and second moveable contacts and the first conductor further comprises a switch for opening the circuit whereby the reversing switch further functions as a disconnect switch.

3. The reversing switch of claim 1 wherein the first, second, third and fourth stationary contacts each comprise finger contacts and the first and second moveable contacts each comprise a moveable blade having a end contact portion.

4. The reversing switch of claim 3 wherein the first and second moveable blade contacts pivot in opposing directions about corresponding pivot point connections with the corresponding second and third input phases, the pivot point on the first moveable blade being intermediate thereof to define a first non-contact end portion for the first moveable blade, and the transmission comprises:

a shaft rotatably connected to the motor, a first lever arm extending radially from the shaft, a first link arm pivotally connected with the first lever arm and the first non-contact end portion of the first moveable blade, and a second lever arm extending radially from the shaft angularly offset from the first lever arm, a second link arm pivotally connected with the second lever arm and the second moveable blade at a location on the second moveable contact between its pivoting point connection and its contact end portion, whereby rotation of the shaft by the motor in opposing directions results in counter pivoting movement of the first and second moveable blades.

5. A reversing switch connected between three input phases and three output phases of an electrical system and having first and second modes of operation of reverse polarity, the reversing switch comprising:

a first conductor linking a first one of the three input phases to a first one of the three output phases;

a first phase switch comprising a first stationary contact adapted for connection with a second one of the three input phases and a second stationary contact adapted for connection with a third one of the three input phases, and the first phase switch comprising a first movable contact adapted for connection with a second one of the three output phases and being movable between a first position contacting the first contact when the reversing switch is operating in the first mode of operation and a second position contacting the second stationary contact when the reversing switch is operating in the second mode of operation;

a second phase switch comprising a third stationary contact adapted for connection with the third one of the three input phases and a fourth stationary contact adapted for connection with the second one of the three input phases, and the second phase switch comprising a second movable contact adapted for connection with a third one of the three output phases and being movable between a third position contacting the third contact when the reversing switch is operating in the first mode of operation and a fourth position contacting the fourth stationary contact when the reversing switch is operating in a second mode of operation; and, a motor and associated transmission adapted for connection with the first and second moveable contacts to move the first and second moveable contacts in unison during switching of the reversing switch between the first and second modes of operation.

6. The reversing switch of claim 5 wherein the first and second phase switches each has a disconnect open position between the corresponding first and second moveable contacts and the first conductor further comprises a switch for opening the circuit whereby the reversing switch further functions as a disconnect switch.

7. The reversing switch of claim 5 wherein the first, second, third and fourth stationary contacts each comprise finger contacts and the first and second moveable contacts each comprise a moveable blade having a end contact portion.

8. The reversing switch of claim 7 wherein the first and second moveable blade contacts pivot in opposing directions about corresponding pivot point connections with the corresponding second and third output phases, the pivot point on the first moveable blade being intermediate thereof to define a first non-contact end portion for the first moveable blade, and the transmission comprises:

a shaft rotatably connected to the motor, a first lever arm extending radially from the shaft, a first link arm pivotally connected with the first lever arm and the first non-contact end portion of the first moveable blade, and a second lever arm extending radially from the shaft angularly offset from the first lever arm, a second link arm pivotally connected with the second lever arm and the second moveable blade at a location on the second moveable contact between its pivoting point connection and its contact end portion, whereby rotation of the shaft by the motor in opposing directions results in counter pivoting movement of the first and second moveable blades.

* * * * *